US006248214B1

(12) United States Patent
Stotz et al.

(10) Patent No.: US 6,248,214 B1
(45) Date of Patent: Jun. 19, 2001

(54) HEADBOX

(75) Inventors: Wolf Gunter Stotz, Ravensburg; Thomas Merath, Weingarten; Klans Lehletter, Mengen; Christoph Link, Weingarten; Josef Frey, Ravensburg, all of (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/411,831

(22) Filed: Oct. 4, 1999

(30) Foreign Application Priority Data

Oct. 5, 1998 (DE) ..... 198 45 722

(51) Int. Cl.[7] ..... D21F 1/02
(52) U.S. Cl. ..... 162/336; 162/347; 162/344
(58) Field of Search ..... 162/272, 336, 162/343, 344, 347

(56) References Cited

U.S. PATENT DOCUMENTS

| | | | | |
|---|---|---|---|---|
| 1,775,905 | | 9/1930 | Lang | 162/336 |
| 3,309,264 | * | 3/1967 | Parker et al. | 162/336 |
| 3,313,681 | | 4/1967 | Dennis et al. | 162/252 |
| 3,738,910 | | 6/1973 | De Noyer | 162/347 |
| 3,909,349 | * | 9/1975 | Stotz et al. | 162/347 |
| 4,406,741 | * | 9/1983 | Kirjavainen | 162/336 |
| 4,731,163 | * | 3/1988 | Ilmoniemi | 162/347 |
| 4,923,569 | | 5/1990 | Nyman et al. | 162/339 |
| 5,298,125 | * | 3/1994 | Fabbris | 162/344 |
| 5,304,285 | | 4/1994 | Meinecke et al. | 162/339 |
| 5,565,064 | * | 10/1996 | Grimm et al. | 162/347 |

FOREIGN PATENT DOCUMENTS

| | | |
|---|---|---|
| 3628699 | 3/1988 | (DE) . |
| 3723922 | 1/1989 | (DE) . |
| 4106764 | 8/1992 | (DE) . |
| 323468 | 6/1990 | (EP) . |
| 631011 | 12/1994 | (EP) . |
| 1595560 | 8/1981 | (GB) . |

* cited by examiner

*Primary Examiner*—Karen M. Hastings
(74) *Attorney, Agent, or Firm*—Greenblum & Bernstein, P.L.C.

(57) ABSTRACT

Headbox for a paper machine having a feed part, a central part extending across the machine width, and a nozzle. The nozzle extends across the machine width and has at least one continuous wall that runs across the machine width transverse to the lengthwise flow. For absorbing and discharging nozzle expansion forces in a sectional manner, several separate individual support devices distributed across the machine width for influencing the nozzle aperture are attached to the at least one, preferably continuous wall. The resulting lines of force of each support device remain at least substantially in a plane lying perpendicular to the direction of the machine width and in the flow direction, and the corresponding supporting forces individually, at least substantially, are directed to and absorbed in the central part in the plane of the flow direction.

45 Claims, 8 Drawing Sheets

HEADBOX

CROSS-REFERENCE TO RELATED APPLICATION

This application claims the priority of German Patent Application 198 45 722.7, filed on Oct. 5, 1998, the disclosure of which is expressly incorporated by reference herein in its entirety.

BACKGROUND OF THE INVENTION

1. Field of the Invention

The present invention relates to a headbox for a paper machine having a feed part, a central part extending across the machine width, and a nozzle extending across the machine width. The headbox also has at least one continuous wall that runs across the machine width transverse to the lengthwise flow direction. The central part may be formed of substantially vertical structural members that penetrate the entire pulp flow and can thereby be subject to compressive or tensile forces in a vertical direction across its entire width and across the machine width.

2. Description of Related Art Conventional headboxes are disclosed, for example, in EP 0 323 468 B 1 and EP 0 631 011 A1. These known headboxes are transversely divided overall into sections, i.e., transverse with respect to the lengthwise flow direction. The advantage of such a construction is that it is independent of width and that the easily manipulated reproducible parts reduce costs. However, the practical realization of such embodiments is difficult. For example, in the areas subject to the flow, a relatively large expenditure is required to prevent agglomeration of fibers and similar substances at the edges of the sections. The cost advantage previously achieved is thus lost.

SUMMARY OF THE INVENTION

An object of the present invention is to provide an improved, low cost headbox of the type specified above, in which the problems cited above are eliminated.

According to the invention, a headbox for a paper machine is provided which includes a feed part, a central part extending across a machine width, a nozzle extending across the machine width, having at least one continuous wall running transverse to a lengthwise flow direction; and a plurality of separate support devices distributed across the machine width are attached to the at least one continuous wall, the support devices absorbing and discharging nozzle expansion forces and influencing the nozzle aperture. The resulting lines of force of each support device lies at least substantially in a plane perpendicular to the direction of the machine width and in the flow direction, and the corresponding supporting forces individually, at least substantially, are directed to and absorbed in the central part in the plane of the flow direction.

The support device may be attached to two opposite walls. The central part may be divided into sections across the machine width. The central part may further include a turbulence generator and a plurality of step diffusers. The feed part may be divided into sections across the machine width.

According to another embodiment, the at least one nozzle wall may be mounted so that it can pivot around an axis extending transversely to the flow direction or can move in the flow direction. The at least one continuous nozzle wall has a flexural strength in the transverse direction, ranging from approximately $5\times10^{10}$ $Nmm^2$ to approximately $7.5\times10^{10}$ $Nmm^2$ per 100 mm of wall length measured in the flow direction. The at least one continuous nozzle wall may be positioned on the individual support devices in a sectional manner.

Each different support device may be individually connected to the central part and at least one continuous nozzle wall. Each support device may be independent so that, at least substantially, any tensile, compression, and/or bending forces are not transmitted therebetween. The at least one support device allocated to a pivoting nozzle wall may further include a static model with at least three bars, which are connected directly from the central part and the pivoting nozzle wall at least substantially at a joint connection location, The at least one bar near the feed part and at least one additional bar near the pivoting axis act on the central part, and at least a third bar acts on the pivoting nozzle wall. The at least three bars may be allocated to a respective support device in or symmetrical with respect to a plane that runs perpendicular to the direction of the machine width and in the lengthwise flow direction. The bar provided near the pivoting axis may directly or indirectly engage the pivotally mounted nozzle wall. In one embodiment, the length of at least one bar is adjustable. Further, the position of at least one point of contact of the bars with the central part or the pivoting nozzle wall is adjustable. Furthermore, a change in all support devices is made in a similar manner by a lifting device, a pneumatic or hydraulic cylinder, or a pneumatic spring bellow, by way of toggle joints allocated to the bars or by a temperature change. The bar lengths or a position of points of impact in all support devices may be changed simultaneously, in the same manner, and evenly, in order to evenly move a pivoting nozzle wall across the entire width in the direction of machine width.

The support devices may have at least one bar to which a device is allocated for individual additional fine adjustment of the nozzle wall. The fine adjustment device is actuated individually or together with other adjustment devices.

According to another embodiment, a one piece slide rest is formed from the bars and is supported on the central part. The one piece slide rest may be formed from the bars supported on the nozzle wall and has a joint connection location in which the bars engage.

According to another embodiment, the nozzle walls are structured without reinforcing ribs and reinforcing sections extending in the transverse direction. Further, the outside of the nozzle walls facing away from the flow may include grooves extending in the flow direction for averaging tension.

According to another embodiment, the headbox also includes a non-pivoting nozzle wall connected by means of ribs or sections to a headbox foundation. Further, the support devices may be equally spaced. Alternatively, the support devices are proportionally spaced. For example, the distances separating the support devices fall may within a range from approximately 50 to approximately 1,000 mm, and preferably in a range from approximately 200 to approximately 500 mm.

According to a further embodiment, the pivoting axis of the pivoting nozzle wall is located near the central part. In addition, the headbox may pivot around a transverse axis located near the nozzle end. In this case, two pivoted bearings may be provided between a headbox side wall and a lateral slide rest. The slide rest may be placed on a seat or a headbox foundation.

According to another embodiment, the headbox is pivoted by at least one adjustable support device that directly or indirectly engages the central part. The support device is provided at a distance from the nozzle end near the central part. The headbox may be pivoted by several support devices distributed across the machine width so that deflection of the headbox structure is at least substantially even in the transverse direction outside of support points. The pivoting axis near the nozzle end may be defined by guidance devices in which it is mounted.

According to another embodiment, the headbox is mounted on at least one support device comprising at least two support units that define two support points having different distances from the nozzle end, and carry out different lifting motions, so that the headbox can be pivoted approximately around the nozzle end.

According to a further embodiment, on the upstream side, a feeding plate is allocated to the central part and reinforces the central part or acts as an attachment element for additional functional elements, the feeding plate extending transversely to the flow direction substantially across the entire width of the central part. The feeding plate may form part of the feed part. In addition, the feeding plate may extend above the level of the feed part.

According to another embodiment, at least one nozzle wall is mounted on a slide rest part attached to the central part so that it can move generally in the flow direction. The nozzle wall can be moved by at least one mechanical, hydraulic, or pneumatic regulating device that engages the slide rest part and the nozzle wall. Further, the regulating device has at least two pintails mounted in the slide rest part, each of which has an eccentric extension that rests in a groove provided in the nozzle wall, wherein the pintails support levers with built-in pivoting nuts that can be actuated by a common adjusting spindle having opposed threads. In addition, the eccentric extensions can be detached from the respective pintails. Finally, the feed part is fed with fiber suspension from individual supply bore holes connected either to long individual tubes or directly to a common distribution pipe positioned substantially parallel to the discharge aperture.

BRIEF DESCRIPTION OF THE DRAWINGS

The invention is described below based on exemplary embodiments, with reference to the drawings.

DETAILED DESCRIPTION OF THE INVENTION

Figure 1:
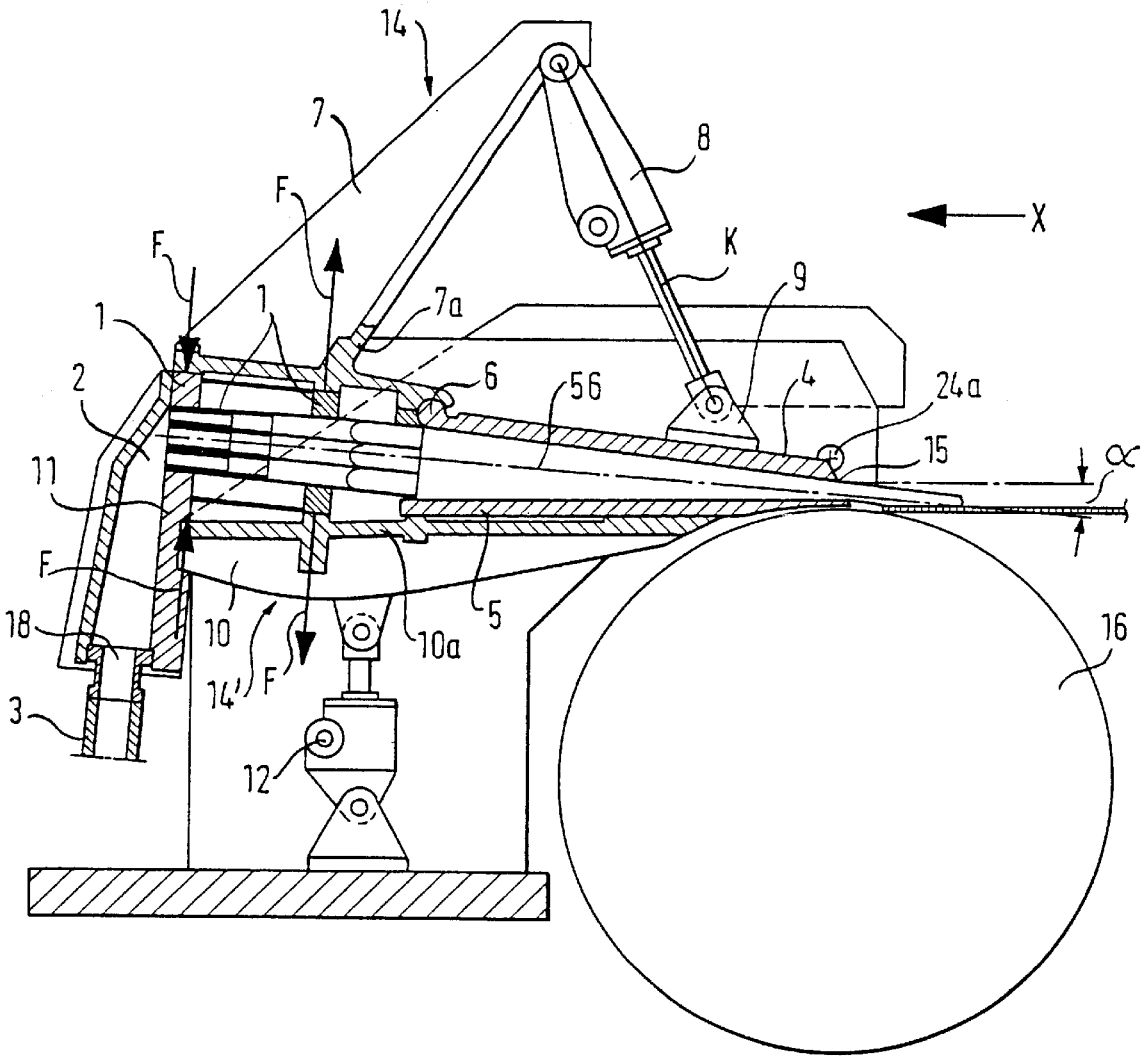
FIG. 1 shows a schematic, partially sectional side view of a first embodiment of a headbox, according to one aspect of the present invention.

According to the present invention, at least to a substantial extent, the headbox elements coming into contact with the pulp flow, which are not mutually adjustable, can be structured in a modular manner. Therefore, through a corresponding combination of modular structural elements and structural elements that, at least substantially, extend across the entire width, the advantages of a modular constructions as specified above are utilized, on the one hand, while agglomerations of fibers and similar substances at the adjustment joints are eliminated at practically no additional expense, on the other hand. In particular, flow-guiding parts downstream from the central part are not structured in a modular manner, while at least one nozzle wall is supported by several separate support devices distributed across the machine width. Thus, the expansion forces arising from the inner nozzle pressure are absorbed relatively evenly across the width. Temperature differences in the support devices, as are known from practice, no longer have any effect on the accuracy of the nozzle aperture, owing to the division into individual modules. In a further embodiment, support devices are attached to two opposite walls.

In an advantageous embodiment, the central part is divided into sections across the machine width. Alternatively or additionally, the feed part can also be divided into sections across the machine width. The central part, for example, can be structured as a turbulence generator and preferably includes several step diffusers.

More advantageously, at least one nozzle wall is mounted so that it can be pivoted around an axis extending transversely to the flow direction and/or moved in the flow direction. Further, at least one continuous nozzle wall supported by several separate support devices is provided, the flexural strength of which in a transverse direction, i.e., in the direction of the machine width, lies in a range from approximately $5\times10^{9}$ $Nmm^{2}$ to approximately $7.5\times10^{10}$ $Nmm^{2}$ per 100 mm of wall length extending in the flow direction. This ensures that the sections are "uncoupled" with respect to deformation.

Advantageously, at least one continuous nozzle wall mounted on several separate support devices can be positioned on the individual support devices in a sectional manner.

In a further embodiment of the headbox according to the invention, the various support devices are individually connected to the central part and the respective nozzle wall. It is particularly advantageous if at least one support device allocated to a pivoting nozzle wall corresponds to a static model with at least three bars, which are connected away from the central part and the pivoting nozzle wall, at least substantially, at a joint connection location. In this case, at least one bar near the feed part and at least one additional bar near the pivoting axis act on the central part, and at least a third bar acts on the pivoting nozzle wall. The at least three bars are allocated to a respective support device in or symmetrical with respect to a plane that runs perpendicular to the direction of the machine width and in the lengthwise flow direction.

Preferably, the length of at least one bar is adjustable. It is also advantageous if the position of at least one point of impact of the bars on the central part and/or on the pivoting nozzle wall is adjustable.

The support devices engaging the nozzle wall can be connected to the central part by means of a base plate, for example. According to a further possible advantageous embodiment, at least one support device has a slide rest part creating a connection to the central part and/or to the nozzle wall. A slide rest part of this type, for example, can be an integral cast or a welded part.

The nozzle walls may be structured without reinforcing ribs and reinforcing sections extending in a crosswise direction. On the outside of the nozzle wall facing away from the flow, grooves may be provided that run in the flow direction for averaging tension.

In a further embodiment, the headbox can pivot around a transverse axis preferably provided near the nozzle end, which directly of indirectly is connected to the central part. By pivoting the headbox, the point of impact of the pulp flow can be adjusted for a downstream drainage unit. Such a construction of the headbox, therefore, is advantageous even without regard to its modular construction.

The pivoting axis of the pivoting headbox can be defined in various ways. For example, two pivot bearings can be provided between a headbox side wall and a lateral slide rest. The pivoting axis preferably provided near the nozzle end, can also be defined by guidance devices in which the headbox is positioned accordingly.

In a further embodiment, the headbox is supported by at least one support device having at least two support units that define two support points located different distances from the nozzle end, and carry out different lifting motions, so that the headbox can be pivoted approximately around the nozzle end.

On the upstream side, a feeding plate serving as a reinforcement of the central part and/or as an attachment element for additional functional elements can be allocated to the central part. The feeding plate extends transversely with respect to the flow direction, substantially across at least the entire width of the central part. A feeding plate of this type can be involved in absorbing the force of the hydraulic pressure of the pulp flow.

In an advantageous embodiment of the headbox according to the present invention, at least one nozzle wall is supported on a slide rest part attached to the central part so that it can move generally in the flow direction.

The headbox for a paper machine, shown schematically in FIG. 1, has a feed part 2, a central part 1, and a nozzle 56. The nozzle 56 has two continuous walls 4, 5, extending across the machine width transverse to the lengthwise flow direction, to which several separate support devices 14, 14', distributed across the machine width, are allocated for absorbing and discharging nozzle expansion forces. The feed part 2 is fed with fiber suspension by way of individual supply bore holes 18. The supply bore holes 18 are connected either to long individual tubes 3 or directly to a common distribution pipe 19 (FIGS. 5 and 7) positioned essentially parallel to the discharge aperture. The central part 1, in this instance, is structured as a turbulence generator and is equipped with several step diffusers. By way of the upper nozzle wall 4 and the lower nozzle wall 5, the flow is guided to a stream outlet 15, where the pulp stream finally exits at an angle $\alpha$ with respect to horizontal.

The upper continuous nozzle wall 4 is positioned so that it can pivot around an axis 6 extending transversely to the lengthwise flow direction, near the central block or central part 1. In this instance, this pivoting axis 6 is defined by a hinge or joint divided into sections across the machine width transverse to the flow direction. Further, this hinge defining the pivoting axis 6 is supported on slide rests 7 of the support devices 14.

Near the stream outlet 15, the pivoted upper nozzle wall 4 is supported by lifting devices 8 that are also part of the support devices 14 and are coupled to the slide rests 7, which engage the nozzle wall 4 by means of a bridge member 9. Accordingly, the forces resulting from the hydraulic pressure in the nozzle 56 are channeled into the central part 1 by way of the lifting devices 8 and the slide rests 7. In this instance, the resulting direction of force K of a support device 14 having, a bridge member 9, a lifting device 8, and a slide rest 7, lies in a plane oriented in the flow direction, perpendicular to the direction of the machine width.

The slide rests 7 are rigidly connected to the central part 1 with a corresponding number of base plates 7*a* or with at least one common base plate, and are screwed down in one embodiment. Otherwise, these slide rests 7 are not connected to each other transverse to the flow direction.

Support devices allocated to the lower nozzle wall 5 can be connected to the central part 1 by way of one or more base plates 10*a*.

If the nozzle walls 4 and 5 are forced apart by the inner nozzle pressure, the expansion forces that arise are absorbed evenly across the width, based on the modular support devices 14 and 14' distributed across the machine width. In this instance, the construction is such that the lines of force K run in a C-shape, when viewed from the side of the headbox. As cin be seen in FIG. 1, the tensile and compression forces run through the central part 1.

The machine-wide pulp stream exiting the discharge aperture or stream outlet 15 enters the area of a breast roll 16 in the conventional manner, on a continuous, circulating traveling wire 17.

Figure 2:
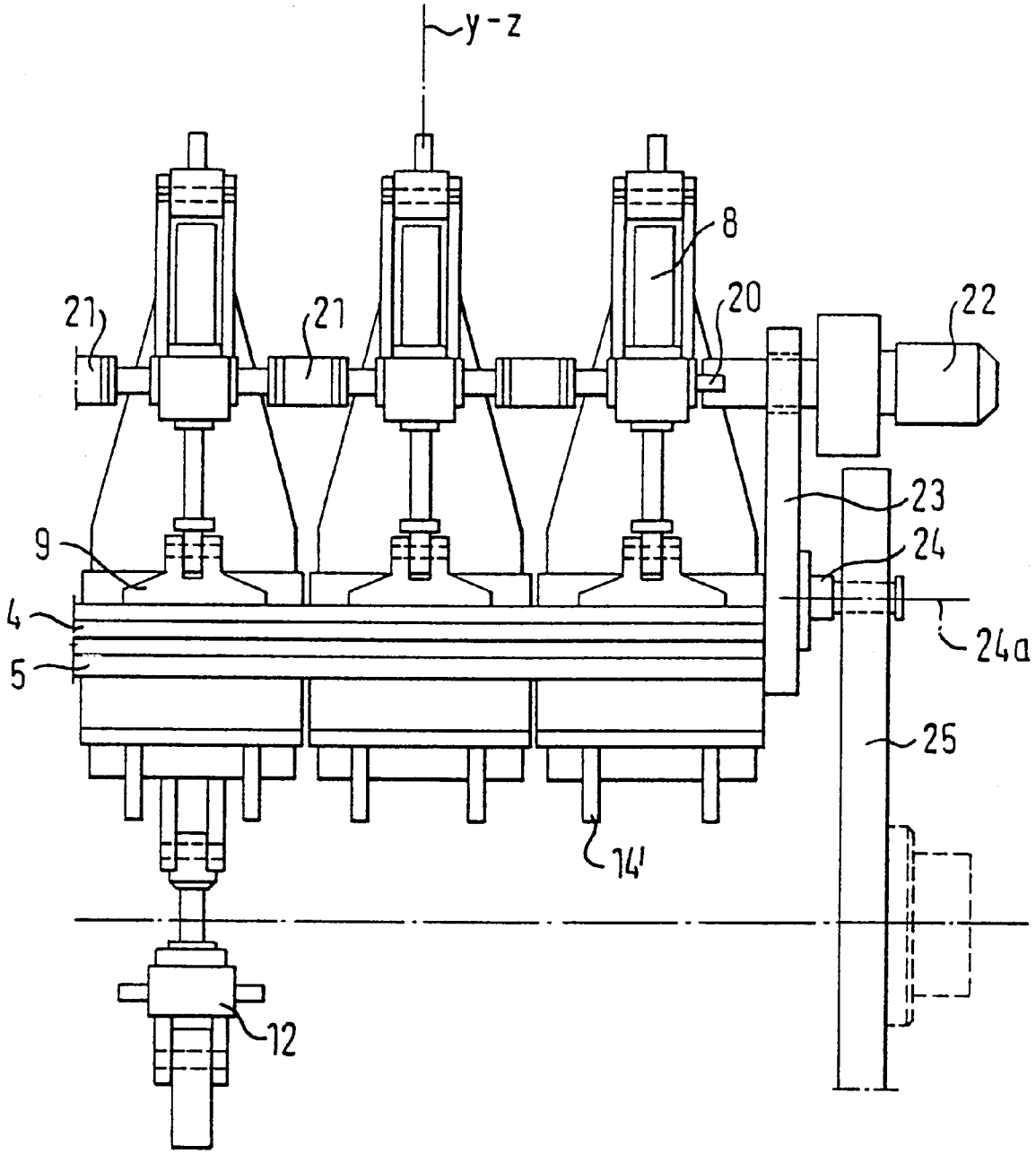
FIG. 2 shows a schematic front view of the headbox according to FIG. 1, in the direction of the arrow X, according to an aspect of the present invention.

As can be seen in FIG. 2, drive journals 20 of adjacent lifting devices 8 are joined together exclusively in a torsionally rigid manner by means of a drive shaft 21 divided into sections across the machine width transverse to the flow direction, so that when an allocated drive 22 is activated, the nozzle wall 4 (see also FIG. 1) is moved in a similar manner across the entire width, without other distortion forces being transmitted by the drive shaft 21.

The lower nozzle wall 5 can be supported in the same manner as the upper nozzle wall 4 by modular support devices 14', each having a lifting device 12, and being distributed across the machine width. A rigid slide rest part 10, structured as a support module, absorbs the hydraulic forces of the nozzle wall 5 and directs them to a central part 1 that forms a central block. By positioning several support devices 14' in series across the machine width, the lower nozzle wall 5 is evenly supported across the entire machine width.

The distribution between upper modular support devices 14 and the distribution between lower modular support devices 14' can be defined in accordance with environmental conditions. For example, a distribution length is conceivable in a range from approximately 50 to approximately 1,000 mm, and preferably in a range from approximately 200 to 500 mm.

The central part 1 gives the entire headbox structure the desired rigidity. This rigidity can be increased by a feeding plate 11, positioned on the upstream side in the central part 1, extending preferably above the level of the feed part 2. At the same time, this feeding plate 11, which preferably extends at least substantially across the entire width of the central part 1 can serve as a structural component of the feed part 2.

The entire headbox is mounted so that it can pivot around an axis 24*a* provided in the area of the nozzle end or stream outlet 15, so that a corresponding stream angle adjustment is possible. In this instance, a journal bearing 24 attached to a slide rest 25 is provided on each side wall 23 of the headbox. The slide rests 25, for example, are placed on a seat and/or a headbox foundation. The pivoting movement is generated by the lifting device 12, which is advantageously positioned near the axis extending through the center of gravity of the headbox.

Figure 3:
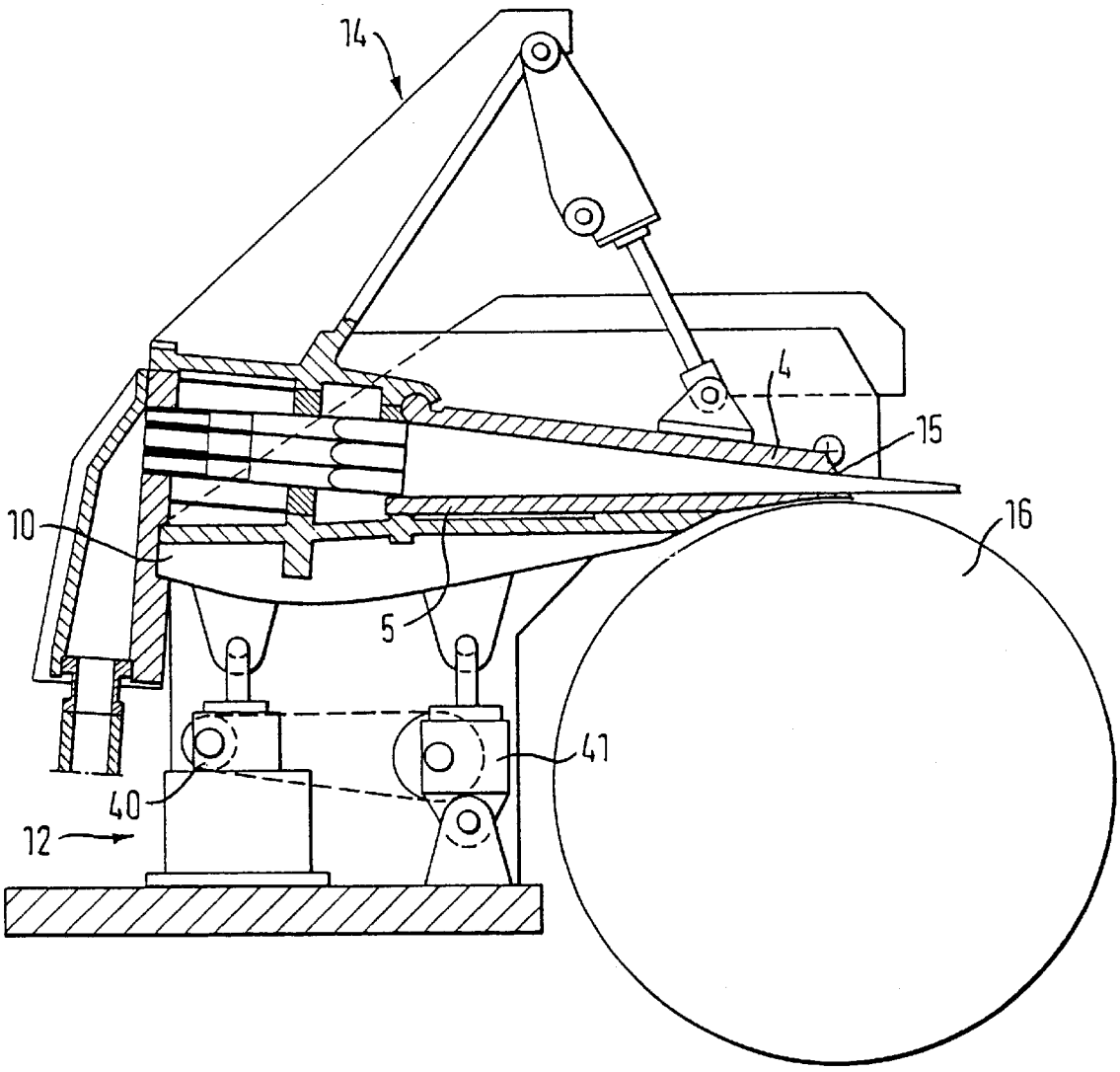
FIG. 3 shows a schematic, partially sectional side view of an embodiment of a pivoting headbox, according to an aspect of the present invention.

FIG. 3 shows a schematic, partially sectional side view of an embodiment of a headbox that is entirely pivoted. In this instance, the headbox is mounted on at least one support device 12 having at least two support units 40, 41, that define two support points having different distances from the nozzle end or stream outlet 15 in the flow direction, and carry out different lifting motions so that the headbox can be pivoted approximately around the nozzle end 15. In this embodiment, the two support units 40, 41 are engaged with the lower rigid slide rest part 10. Otherwise, this embodiment can have the same construction as shown in FIGS. 1 and 2, where similar parts are assigned the same reference numbers.

Figure 4:
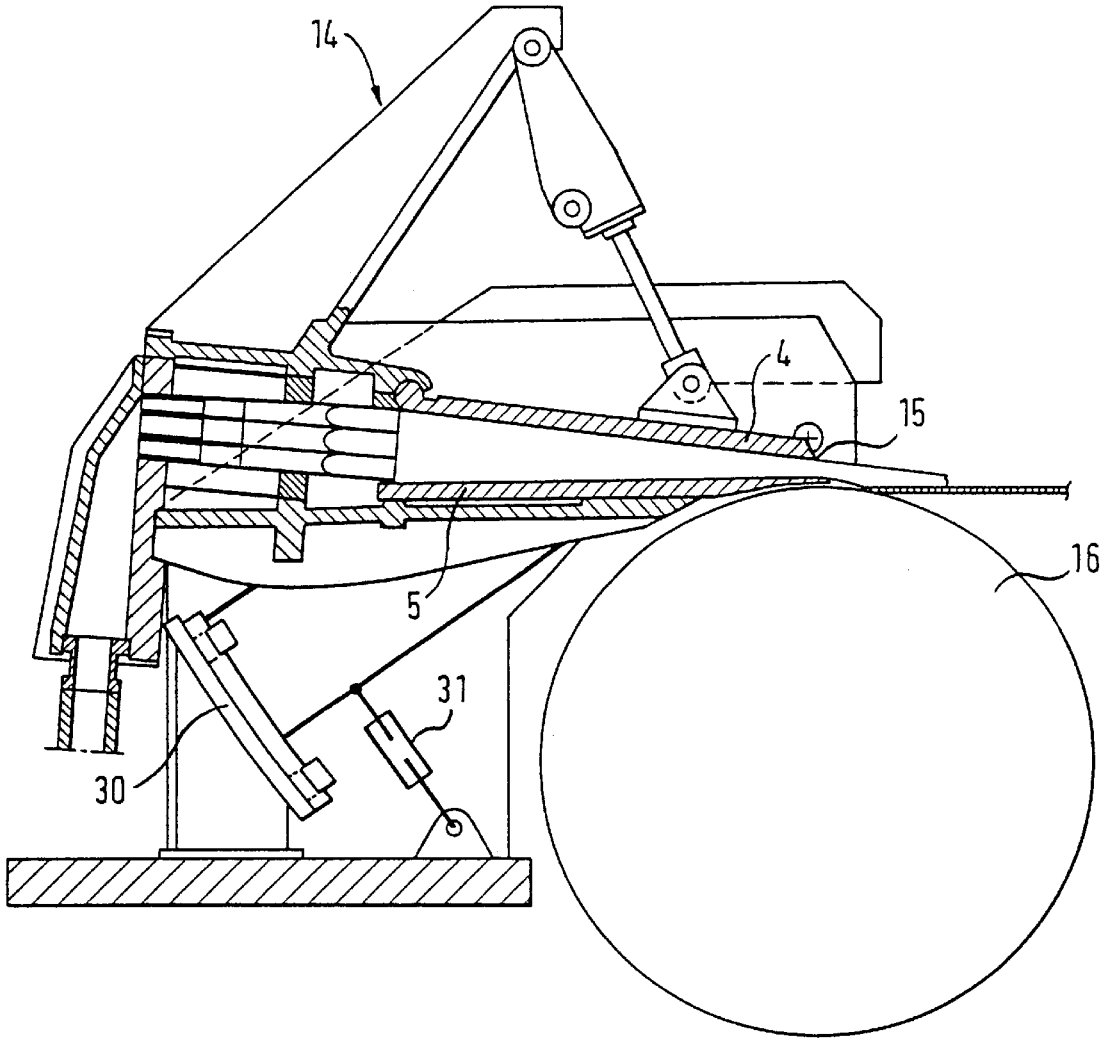
FIG. 4 shows a schematic, partially sectional side view of an additional embodiment of a pivoting headbox, according to an aspect of the present invention.

FIG. 4 shows a schematic, partially sectional side view of an additional embodiment of a pivoting headbox. In this embodiment, the pivot axis of the headbox, provided preferably near the nozzle end 15, is defined by guidance devices 30 on which the headbox is mounted. Upon activation of regulating device 31, the headbox pivots around the axis near the nozzle ends defined by the guidance devices 30. Otherwise, this embodiment can again have the same construction as shown in FIGS. 1 and 2, where similar parts are assigned the same reference numbers.

Figure 6:
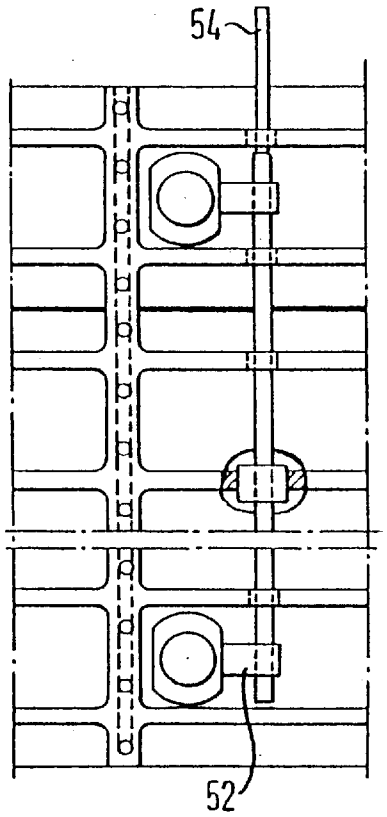
FIG. 6 shows a section through the regulating device allocated to the adjustable nozzle wall, cut along line I—I in FIG. 5, according to an aspect of the present invention.
Figure 5:
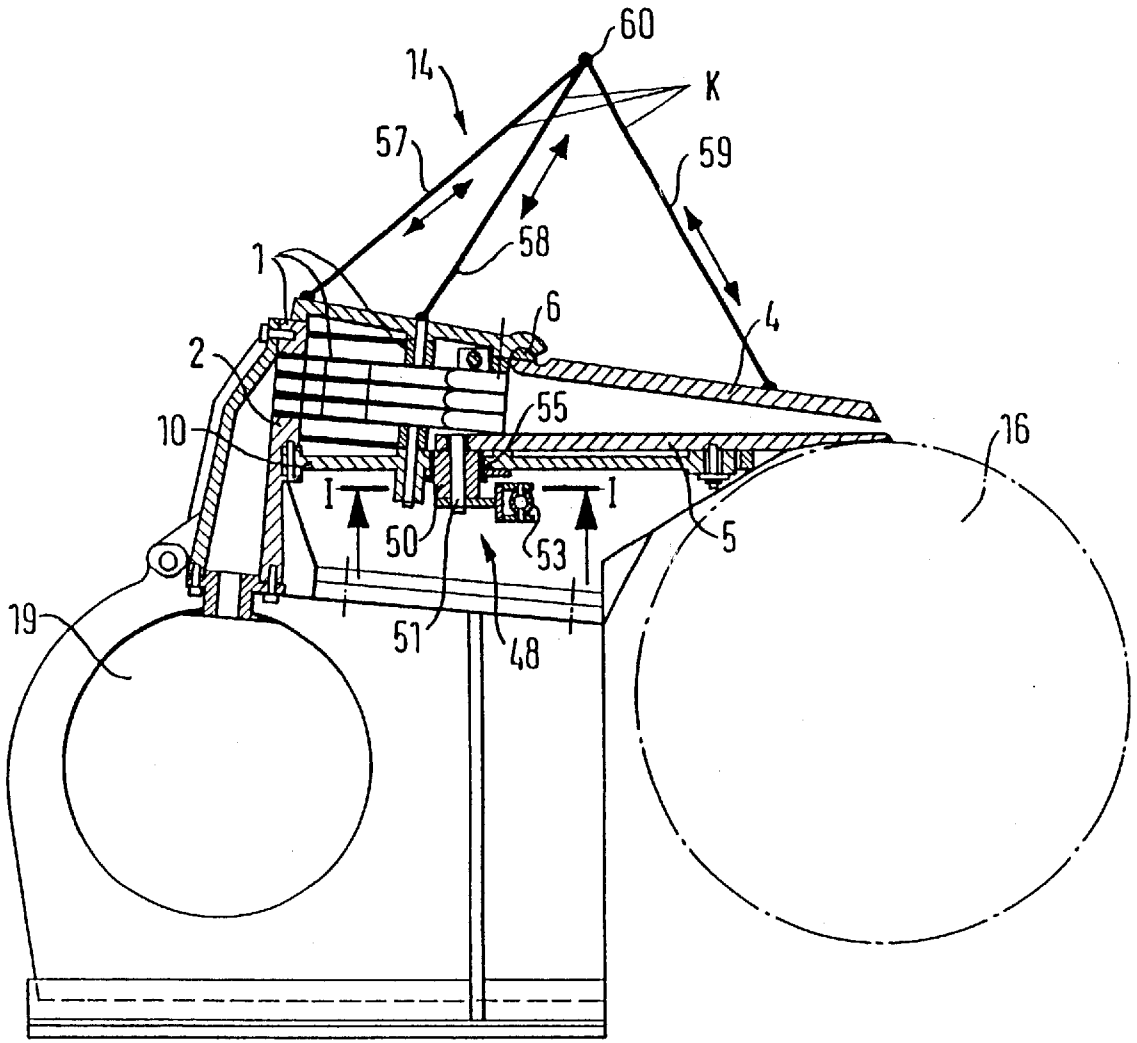
FIG. 5 shows a schematic, partially sectional side view of an additional embodiment of a headbox with an adjustable nozzle wall and a schematically shown support device formed by a construction of bars, the middle bar of which engages the central part, according to an aspect of the present invention.

FIGS. 5 and 6 show a schematic representation of an additional embodiment of a headbox in which the lower nozzle wall 5 is mounted so that it slides on the slide rest part 10 and can be moved relative to it in the lengthwise flow direction. In this arrangement, the nozzle wall 5 can be moved in the desired direction by at least one mechanical, hydraulic, and/or pneumatic regulating device 48. This regulating device 48 engages with the slide rest part 10 and the nozzle wall 5.

As can be seen in FIGS. 5 and 6, the regulating device 48 has two pintails 50 mounted in the slide rest part 10, each of which has an eccentric extension 51 that fits in a groove 55 in the nozzle wall 5. The pintails 50 carry support levers 52 with built in pivoting nuts 53 that can be actuated by way of a common adjusting spindle 54 (see FIG. 6) having complementary threads. Preferably, the eccentric attachments 51 can be detached from the respective pintails 50. Otherwise, this embodiment can again have the same construction as shown in FIGS. 1 and 2, where similar parts are assigned the same reference numbers.

In addition, FIG. 5 shows a schematic representation of another embodiment for a support device 14, which can be used in other embodiments of the headbox. The support device 14 is formed by a plurality of bars, in a further embodiment three bars 57, 58, and 59, which are supported and braced on the central part 1 and/or the upper nozzle wall 4. The bars extends from the central part 1 and/or upper nozzle wall 4 to a joint connection location 60. Accordingly, the support devices 14 allocated to the pivoting nozzle wall 4 correspond to a static model having, in this embodiment, three bars 57, 58, 59 that are joined away from the central part 1 and the pivoting nozzle wall 4 at the joint connection location 60. The bar 57 acts on the central part 1 near the feed part 2, the middle bar 58 near the pivoting axis 6, and the third bar 59 on the nozzle wall 4 mounted pivotally. In this arrangement, the bars 57, 58, and 59 of the support device 14 are arranged symmetrical to a plane that runs perpendicular to the direction of the machine width and in the flow direction. In this instance, the bars 57, 58, and 59 are arranged in a plane running perpendicular to the direction of the machine width and in the lengthwise flow direction, i.e., in the plane of the drawing of FIG. 5. In the exemplary embodiment shown in FIG. 5, the bar 58 near the pivoting axis 6 can engage the central part 1 directly or indirectly. In accordance with a feature of the instant invention, the length of at least one of the bars 57, 58, and 59 is adjustable. Further, the position of at least one point of contact of the bars 57, 58, and 59 with the central part or the pivoting nozzle wall is adjustable. A change in all support devices is made in a similar manner by a lifting device, a pneumatic or hydraulic cylinder, or a pneumatic spring bellow, by way of toggle joints allocated to the bars or by a temperature change. Moreover, the bar lengths or a position of points of impact in all support devices are configured to be changed simultaneously, in the same manner, and evenly, in order to evenly move a pivoting nozzle wall across the entire width in the direction of machine width. Still further, the support devices have at least one bar allocated to a device for individual additional fine adjustment of the nozzle wall, and the fine adjustment device is actuated individually or together with other adjustment devices. A one piece slide rest is formed from the bars and is supported on the central part. Further still, a one piece integral slide rest is formed from the bars supported on the nozzle wall and has a joint connection location in which the bars engage.

Figure 7:
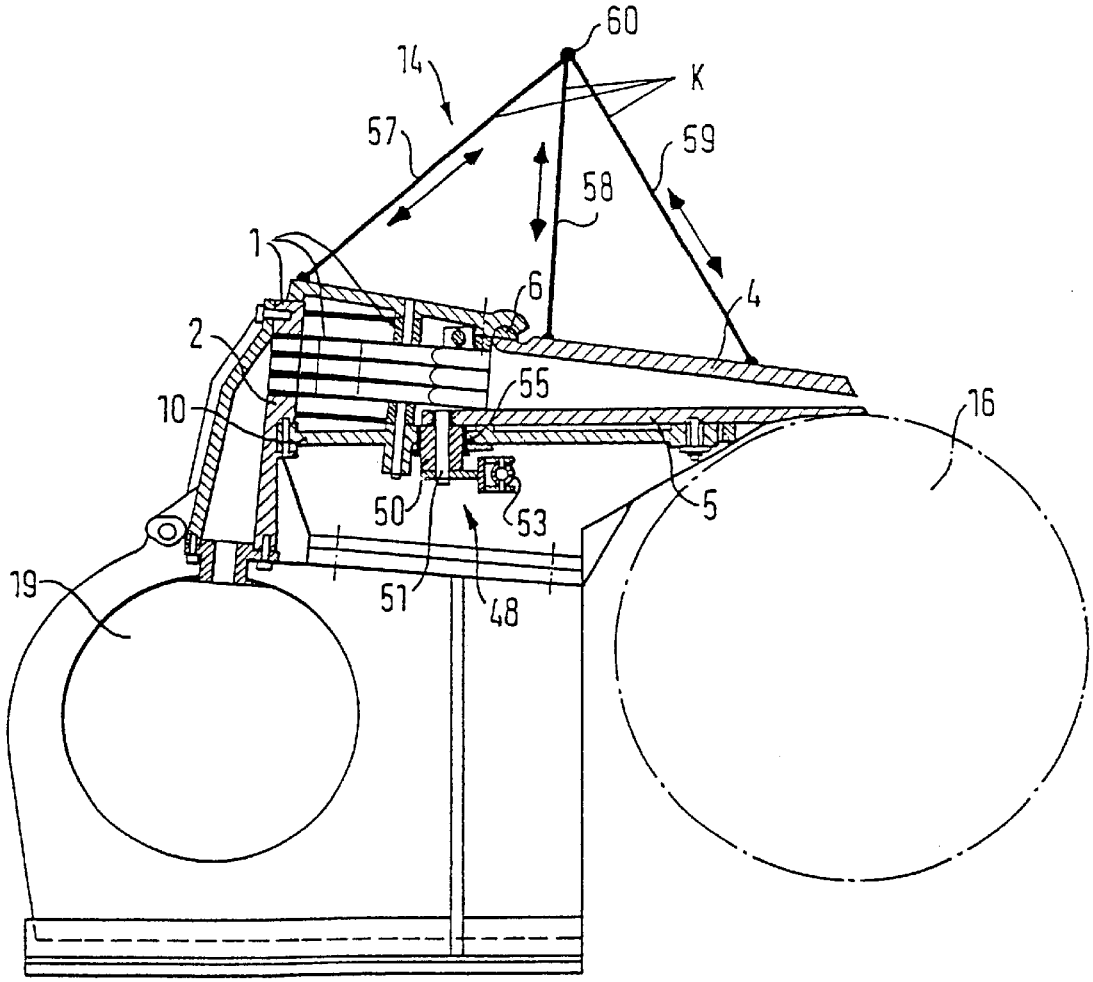
FIG. 7 shows a schematic, partially sectional side view of an additional embodiment of a headbox, comparable to the one in FIG. 5, with a schematically shown support device formed by a construction of bars, the middle bar of which, however, engages the pivoting nozzle wall, according to an aspect of the present invention.

FIG. 7 shows a schematic, partially sectional side view of an additional embodiment of a headbox similar to the headbox shown in FIG. 5, with a support device 14 formed by a plurality of bars. In this embodiment, the middle bar 58 is provided near the pivoting axis 6 and directly or indirectly engages the nozzle wall 4, mounted so that it can pivot around the axis 6. Otherwise this embodiment can have the same construction shown in FIGS. 5 and 6, where similar parts are assigned the same reference numbers.

Figure 8:
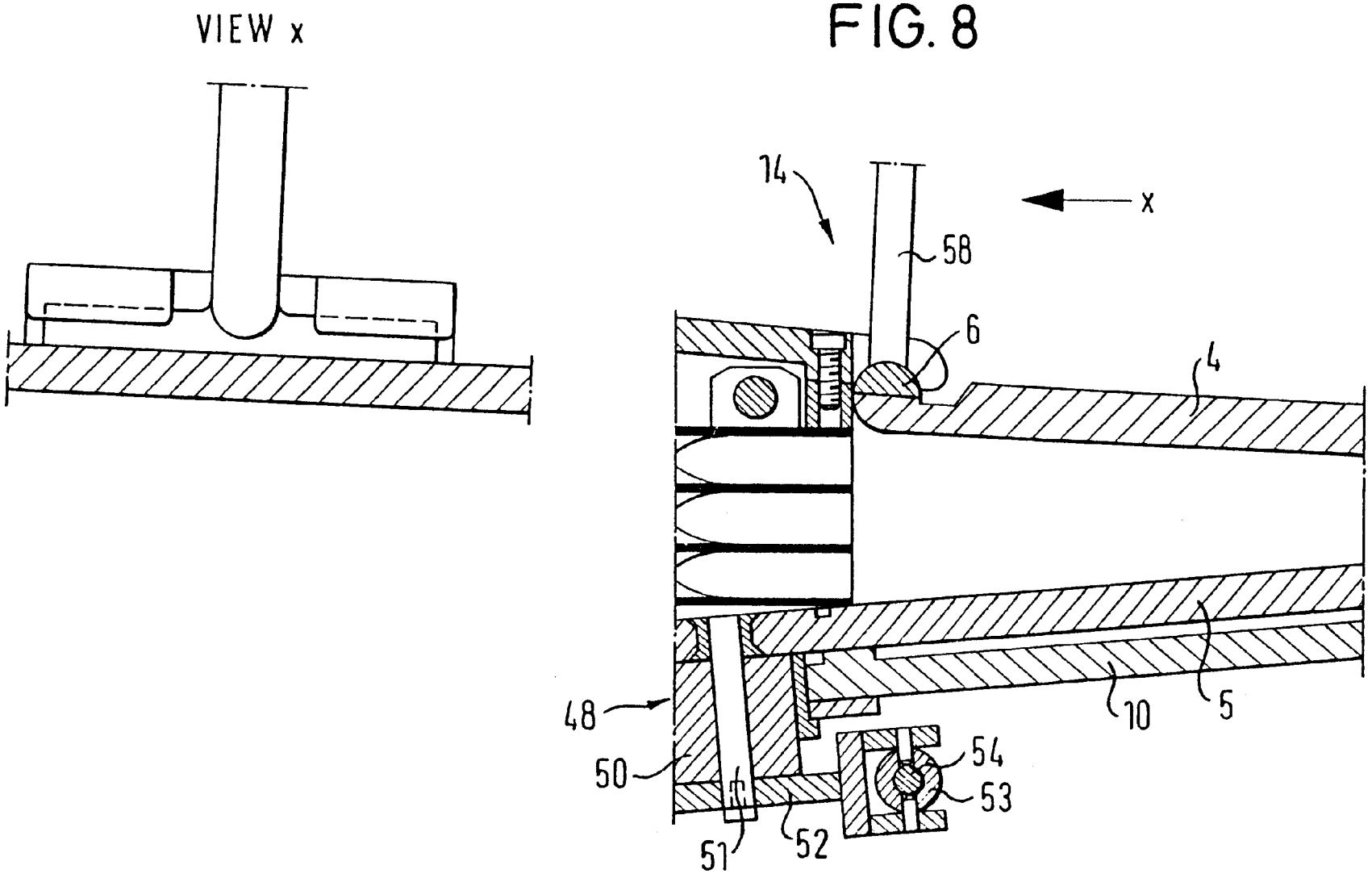
FIG. 8 shows a schematic, partially sectional side view of an additional embodiment of a headbox, comparable to the one in FIG. 5, with a schematically shown support device formed by a construction of bars, the middle bar of which, however, engages the joint of the pivoting nozzle wall, according to an aspect of the present invention.

FIG. 8 shows a schematic, partially sectional side view of an additional embodiment of a headbox, similar to the headbox shown in FIG. 5, with upper support devices 14 formed by a bar construction. In this exemplary embodiment, this middle bar 58 of support device 14 engages the joint of the pivoting upper nozzle wall 4 defining the pivoting axis 6. The left part of FIG. 8 shows a view x of the anchoring of a bar end to the nozzle wall.

Otherwise this embodiment can have the same construction as shown in FIG. 5, where similar parts are again assigned the same reference numbers.

Figure 9:
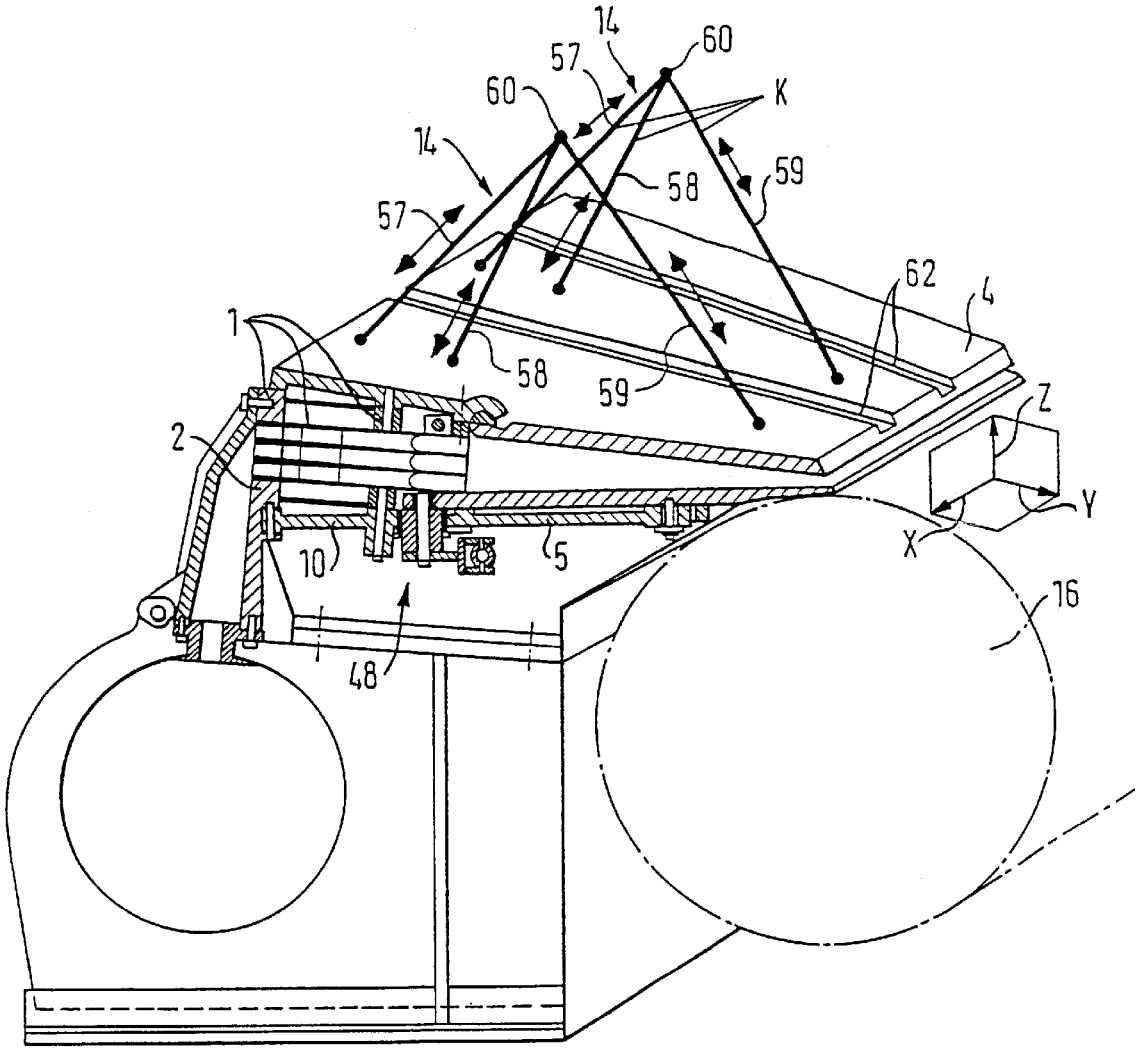
FIG. 9 shows a schematic, partially sectional side view of an additional embodiment of a headbox, comparable to the one in FIG. 5, where two of the support devices distributed across the machine width are shown, according to an aspect of the present invention.

FIG. 9 shows a schematic, partially sectional side view of an additional embodiment of a headbox that is similar to the embodiment shown in FIG. 5, in which two of the support devices 14 distributed across the machine width are shown. A system of coordinates is shown with X, Y, and Z axes. In this arrangement, the X axis corresponds to the direction of the width of the paper machine, while the Y axis corresponds to the lengthwise flow direction. The Z axis runs perpendicular to the X-Y plane. Accordingly, the support devices 14 are arranged one after the other along the X axis, while the bars 57, 58, and 59 of a respective support device 14 each lie in a Y-Z plane. The continuous upper nozzle wall 4 supported on these separate support devices 14, therefore, can be positioned sectionally across the individual support devices 14.

In this embodiment, the middle bar 58 engages the central part 1 either directly or indirectly. However, a bar construction is also possible in which the middle bar 58 of a support device 14 directly or indirectly engages either the pivotable nozzle wall 4 or the joint defining the pivoting axis 6. Otherwise, this embodiment can have the same construction as the previous exemplary embodiments, where similar parts are again assigned the same reference numbers. On the outside of the nozzle walls 4, 5 facing away from the flow, grooves 62 may be provided that extend in the flow direction and serve to average tension, as can be seen in FIG. 9, for example.

While the invention has been described with reference to several exemplary embodiments, it is understood that the words that have been utilized are words of description and illustration, rather than words of limitation. Changes may be made, within the purview of the appended claims, as presently stated and as amended, without departing from the scope and spirit of the invention in its aspects. Although the invention has been described with reference to particular means, materials and embodiments, the invention is not intended to be limited to the particulars disclosed; rather, the invention extends to all functionally equivalent structures, methods and uses, such as are within the scope of the appended claims.

What is claimed:

1. A headbox for a paper machine comprising:

a feed part;

a central part extending across a machine width;

a nozzle extending across the machine width, having at least one continuous wall running transverse to a lengthwise flow direction; and a plurality of separate support devices distributed across the machine width being attached to the at least one continuous wall, the support devices absorbing and discharging nozzle expansion forces and adjusting the nozzle aperture, wherein resulting lines of force of each support device lie at least substantially in a plane perpendicular to the direction of the machine width and in the flow direction, and the corresponding supporting forces are substantially directed to and absorbed in the central part in the plane of the flow direction.

2. The headbox of claim 1, wherein the support devices are attached to two opposite walls.

3. The headbox of claim 1, wherein the central part is divided into sections across the machine width.

4. The headbox of claim 1, the central part further comprising a turbulence generator and a plurality of step diffusers.

5. The headbox of claim 1, wherein the feed part is divided into sections across the machine width.

6. The headbox of claim 1, wherein the at least one continuous wall is mounted so that it can pivot around an axis extending transversely to the flow direction or can move in the flow direction.

7. The headbox of claim 1, wherein the at least one continuous wall has a flexural strength in the transverse direction, ranging from approximately $5\times10^{9}$ $Nmm^2$ to approximately $7.5\times10^{10}$ $Nmm^2$ per 100 mm of wall length measured in the flow direction.

8. The headbox of claim 1, wherein the at least one continuous wall is positioned on the individual support devices in a sectional manner.

9. The headbox of claim 1, wherein each of the plurality of support devices is individually connected to the central part and at least one continuous nozzle wall.

10. The headbox of claim 1, wherein each of the plurality of support devices is independent so that, at least substantially, any tensile, compression, and/or bending forces are not transmitted therebetween.

11. The headbox of claim 1, wherein the at least one continuous wall is structured without reinforcing ribs and reinforcing sections extending in the transverse direction.

12. The headbox of claim 11, wherein the outside of the at least one continuous wall facing away from the flow further comprises grooves extending in the flow direction for averaging tension.

13. The headbox of claim 1, further comprising a non-pivoting nozzle wall connected by ribs or sections to a headbox foundation.

14. The headbox of claim 1, wherein the at plurality of support devices are equally spaced.

15. The headbox of claim 1, wherein the plurality of support devices are proportionally spaced.

16. The headbox of claim 1, wherein the distances separating the plurality of support devices fall within a range from approximately 50 to approximately 1,000 mm.

17. The headbox of claim 1, wherein the at least one continuous wall comprises a pivotably mounted wall having a pivoting axis located near the central part.

18. The headbox of claim 1, wherein the headbox pivots around a transverse axis located near a nozzle end.

19. The headbox of claim 18, wherein two pivoted bearings are provided between a headbox side wall and a lateral slide rest.

20. The headbox of claim 19, wherein the slide rest is placed on a seat or a headbox foundation.

21. The headbox of claim 1, wherein the headbox is pivoted by at least one of the plurality of support devices that directly or indirectly engages the central part.

22. The headbox of claim 21, wherein the at least one support device is provided at a distance from the nozzle end near the central part.

23. The headbox of claim 1, wherein the headbox is pivoted by several of the plurality of support devices distributed across the machine width so that deflection of the headbox structure is at least substantially even in the transverse direction outside of support points.

24. The headbox of claim 1, wherein a pivoting axis near the nozzle end is defined by guidance devices in which it is mounted.

25. The headbox of claim 1, wherein the headbox is mounted on at least one of the plurality of support devices, which comprises at least two support units that define two support points having different distances from the nozzle end, and carry out different lifting motions, so that the headbox can be pivoted approximately around the nozzle end.

26. The headbox of claim 1, wherein, on the upstream side, a feeding plate is allocated to the central part and reinforces the central part or acts as an attachment element for additional functional elements, the feeding plate extending transversely to the flow direction substantially across the entire width of the central part.

27. The headbox of claim 26, wherein the feeding plate forms part of the feed part.

28. The headbox of claim 26 wherein the feeding plate extends above the level of the feed part.

29. The headbox of claim 1, wherein the at least one continuous wall comprises a nozzle wall that is mounted on a slide rest part attached to the central part so that it can move generally in the flow direction.

30. The headbox of claim 29, wherein the nozzle wall can be moved by at least one mechanical, hydraulic, or pneumatic regulating device that engages the slide rest part and the nozzle wall.

31. The headbox of claim 30, wherein the regulating device has at least two pintails mounted in the slide rest part, each of which has an eccentric extension that rests in a groove provided in the nozzle wall, wherein the pintails support levers with built-in pivoting nuts that can be actuated by a common adjusting spindle having opposed threads.

32. The headbox of claim 31, wherein the eccentric extensions can be detached from the respective pintails.

33. The headbox of claim 1, wherein the feed part is fed with fiber suspension from individual supply bore holes connected either to long individual tubes or directly to a common distribution pipe positioned substantially parallel to the discharge aperture.

34. The headbox of claim 1, wherein the distances separating the plurality of support devices fall within a range from approximately 200 to approximately 500 mm.

35. A headbox for a paper machine comprising:

a feed part;

a central part extending across a machine width;

a nozzle extending across the machine width, having at least one continuous wall running transverse to a lengthwise flow direction;

a plurality of separate support devices distributed across the machine width being attached to the at least one continuous wall, the support devices absorbing and discharging nozzle expansion forces and adjusting the nozzle aperture, wherein resulting lines of force of each support device lie at least substantially in a plane perpendicular to the direction of the machine width and in the flow direction, and the corresponding supporting forces are substantially directed to and absorbed in the central part in the plane of the flow direction, and the at least one continuous wall comprising at least one pivotably mounted wall; and at least one of the plurality of separate support devices is allocated to the at least one pivotably mounted wall, the at least one support device comprising a static model with at least three bars, which are connected directly from the central part and from the at least one pivotably mounted wall at least substantially to a joint connection location, wherein at least a first bar of the at least three bars near the feed part and at least a second bar of the at least three bars near a pivoting axis act on the central part, and at least a third bar of the at least three bars acts on the pivotably mounted wall, and wherein the at least three bars of the at least one support device lie in or are symmetrical with respect to a plane extending perpendicular to the direction of the machine width and in the lengthwise flow direction.

36. The headbox of claim 35, wherein the bar provided near the pivoting axis directly or indirectly engages the pivotably mounted nozzle wall.

37. The headbox of claim 35, wherein the length of at least one of the at least three bars is adjustable.

38. The headbox of claim 35, wherein the position of at least one point of contact of the bars with the central part or the pivoting nozzle wall is adjustable.

39. The headbox of claim 37, wherein a change in all support devices is made in a similar manner by a lifting device, a pneumatic or hydraulic cylinder, or a pneumatic spring bellow, by way of toggle joints allocated to the bars or by a temperature change.

40. The headbox of claim 37, wherein the bar lengths or a position of points of impact in all support devices are configured to be changed simultaneously, in the same manner, and evenly, in order to evenly move the at least one continuous wall across the entire width in the direction of machine width.

41. The headbox of claim 39, wherein the support devices have at least one bar allocated to a device for individual additional fine adjustment of the nozzle wall.

42. The headbox of claim 41, wherein the fine adjustment device is actuated individually or together with other adjustment devices.

43. The headbox of claim 35, wherein a one piece slide rest is formed from the bars and is supported on the central part.

44. The headbox of claim 35, wherein a one piece integral slide rest is formed from the bars supported on the nozzle wall and has a joint connection location in which the bars engage.

45. A headbox for a paper machine comprising:

a feed part divided into sections across a machine width;

a central part extending across the machine width and divided into sections across the machine width, the central part comprising, on an upstream side, a feeding plate that reinforces the central part or acts as an attachment element for additional functional elements, the feeding plate extending transversely to the flow direction substantially across the entire width of the central part;

a nozzle extending across the machine width, having at least one continuous wall extending transversely to a lengthwise flow direction, and either mounted so that it can pivot around an axis extending transversely to the flow direction or mounted on a slide rest part attached to the central part so that it can move generally in the flow direction, the at least one continuous wall being either pivotably or slidably moved by at least one mechanical, hydraulic, or pneumatic regulating device that engages the at least one continuous wall; and a plurality of separate support devices distributed across the machine width are attached to the at least one continuous wall, the support devices absorbing and discharging nozzle expansion forces and adjusting the nozzle aperture, the headbox being mounted on at least one of the plurality of support devices, which comprises at least two support units that define two support points having different distances from the nozzle end, and carry out different lifting motions, so that the headbox can be pivoted approximately around a nozzle end, at least one of the plurality of support devices, which is allocated to the at least one continuous wall, comprising a static model with at least three bars, which are connected, at least substantially at a joint connection location, directly from the central part and the at least one continuous wall, wherein at least a first bar of the at least three bars near the feed part and at least a second bar of the at least three bars near the pivoting axis act on the central part, and at least a third bar of the at least three bars acts on the at least one continuous wall, wherein the at least three bars are arranged in or symmetrical with respect to a plane that runs perpendicular to the direction of the machine width and in the lengthwise flow direction, and wherein resulting lines of force of each of the plurality of support devices lie at least substantially in a plane perpendicular to the direction of the machine width and in the flow direction, and the corresponding supporting forces individually, at least substantially, are directed to and absorbed in the central part in the plane of the flow direction.

* * * * *